US009111736B2

(12) United States Patent
Asano

(10) Patent No.: US 9,111,736 B2
(45) Date of Patent: Aug. 18, 2015

(54) MASS SPECTROMETER

(75) Inventor: Natsuyo Asano, Kyoto (JP)

(73) Assignee: Shimadzu Corporation, Kyoto-Shi (JP)

( * ) Notice: Subject to any disclaimer, the term of this patent is extended or adjusted under 35 U.S.C. 154(b) by 0 days.

(21) Appl. No.: 14/004,297

(22) PCT Filed: Mar. 11, 2011

(86) PCT No.: PCT/JP2011/055769
§ 371 (c)(1),
(2), (4) Date: Sep. 17, 2013

(87) PCT Pub. No.: WO2012/124020
PCT Pub. Date: Sep. 20, 2012

(65) Prior Publication Data

US 2014/0001354 A1 Jan. 2, 2014

(51) Int. Cl.
*H01J 49/02* (2006.01)
*H01J 49/00* (2006.01)

(52) U.S. Cl.
CPC ..... *H01J 49/02* (2013.01); *H01J 49/005* (2013.01); *H01J 49/0009* (2013.01)

(58) Field of Classification Search
CPC ..... H01J 49/02
USPC ..... 250/288
See application file for complete search history.

(56) References Cited

U.S. PATENT DOCUMENTS 5,449,902 A 9/1995 Onishi et al.
6,166,378 A 12/2000 Thomson et al.
7,479,629 B2 1/2009 Overney et al.
2005/0236565 A1 10/2005 Oser et al.
2008/0073496 A1 * 3/2008 Overney et al. ..... 250/282
2008/0217527 A1 9/2008 Wang

FOREIGN PATENT DOCUMENTS

DE 102007039970 A1 3/2008
JP 63-187547 8/1988
JP 6-201650 7/1994
JP 2007-535097 A 11/2007

(Continued)

OTHER PUBLICATIONS

International Search Report dated Apr. 19, 2011 for International Patent Application No. PCT/JP2011/055769 filed on Mar. 11, 2011.

(Continued)

*Primary Examiner* — Phillip A Johnston
(74) *Attorney, Agent, or Firm* — Morgan, Lewis & Bockius LLP

(57) ABSTRACT

After a first sample injection by a flow injection method, ion intensity of each product ions is measured by varying collision energy at coarse intervals over a wide energy range in a coarse adjustment mode (S1, S2). The integrated strength values of each type of product ions are compared among different levels of collision energy, and if there is any significant difference, the energy level corresponding to the largest integrated intensity value is determined as an approximate value (S3, Y in S4). Subsequently, a narrow energy range centering around the approximate value and a small interval are determined, the mode is switched to a fine adjustment mode, and the intensity of each product ions is measured by varying collision energy as in the case of the coarse adjustment mode.

5 Claims, 4 Drawing Sheets

(56) References Cited

FOREIGN PATENT DOCUMENTS

| | | | |
|---|---|---|---|
| JP | 2010-520605 | A | 6/2010 |
| WO | 2005/104177 | A2 | 11/2005 |
| WO | 2011/010649 | A1 | 1/2011 |

OTHER PUBLICATIONS

Extended European Search Report received for European Patent Application No. 11861141.7, mailed on Feb. 12, 2015, 9 pages.

Examination Report Received for Japanese Patent Application No. 2013-504419, mailed on Mar. 24, 2015, 3 pages (1 page of English Translation and 2 pages of Official Copy).

Examination Report received for Japanese Patent Application No. 2013-504419, mailed on Sep. 9, 2014, 5 pages (2 pages of English Translation and 3 pages of Office Action).

Examination Report Received for Chinese Patent Application No. 201180069217.2 mailed on May 6, 2015, 9 pages. (2 pages of English Translation and 7 pages of Official Copy).

* cited by examiner

MASS SPECTROMETER

TECHNICAL FIELD

The present invention relates to the mass spectrometer including a triple quadrupole mass spectrometer, and more particularly, to a mass spectrometer for performing mass spectrometry of components of a sample eluating from a column of a liquid chromatograph or of a liquid sample introduced by a flow injection method.

BACKGROUND ART

When tuning up various parts of a liquid chromatograph mass spectrometer (LC/MS), the mass spectrometer uses a sample containing components of known types and densities. The tuning as referred to herein involves optimizing control parameters related to analysis conditions such as applied voltages of various parts, temperatures of an ionization probe, and a gas flow rate for the purpose of mass-to-charge ratio (m/z) calibration, mass resolution adjustment, and sensitivity adjustment. The tuning involves monitoring a signal strength corresponding to an amount of ions originating from a target component in the sample and searching for parameter values which maximize the signal strength while changing values of the control parameters to be adjusted. Therefore, a certain amount of time is required to find optimal values of the control parameters, and conventionally it is general practice to use an infusion method to introduce the sample into an ion source. The infusion method is a technique which continuously introduces a liquid sample into the ion source using a syringe pump or the like, and the method enables stable analysis for a relatively extended period of time, but has the disadvantage of involving high sample consumption.

In contrast, a flow injection (FIA) method is a technique which injects a predetermined quantity of a sample into a mobile phase flowing at a constant rate, using an injector for liquid chromatograph or the like, and introduces the sample into an ion source together with the mobile phase (see Patent Document 1 and other documents). Consequently, the flow injection method uses a far smaller quantity of the sample than the infusion method described above. However, in the case of the FIA method, the time when the sample is introduced into the ion source is considerably limited, and moreover the density of the target component broadens to a bell-shaped (or peak-shaped) distribution with the passage of time. Therefore, when a sample is introduced by the FIA method, the data collecting time in an equipment tuning is greatly restricted compared to the infusion method.

As an example of equipment tuning, description will be given below of a case in which collision energy used for collision-induced dissociation (CID) of ions is optimized on a triple quadrupole mass spectrometer capable of MS/MS analysis. Since the collision energy possessed by the ions at the time of a dissociation operation depends on the voltages applied to the collision cell, ion optical elements in the preceding stage, and the like, the collision energy discussed here is actually the voltages which determine the collision energy.

Generally, the manner of CID-based ionic dissociation varies with the collision energy. Therefore, for the same precursor ions, an optimal value of the collision energy may vary with intended product ions. Thus, in the case of MS/MS analysis, such as multiplex reaction monitoring (MRM) measurement, in which the mass-to-charge ratio of the product ions is fixed, if there are multiple types of intended product ions, the optimal value of collision energy needs to be found for each type of the product ions.

Patent Document 2 describes a known technique for detecting respective intensities of plural product ions generated when predetermined precursor ions are dissociated at plural levels of collision energy set beforehand. With this analysis method, all combinations of the levels of collision energy and plural product ions are analyzed in one cycle, and the intensities of each product ion at different levels of collision energy are obtained by repeating this cycle.

However, with a technique which comprehensively acquires ion intensities as described above, if an appropriate range of collision energy is totally unknown, it is necessary to measure the intensity of each product ion by changing the value at relatively small intervals over a considerably wide range of collision energy. This increases the number of data items to be acquired during one cycle, or increases the duration of each cycle if data acquisition time intervals are kept constant. With the FIA method, since the density of a sample component introduced into the ion source changes to a bell-shaped (peak-shaped) distribution as described above, it is difficult to find the optimal value of collision energy based solely on analysis results of a single cycle. This makes it necessary to find the optimal value of collision energy by accumulating the ion intensity values for several cycles. If, however, the time required for one cycle is long as described above, it might not be possible to find the optimal value within the time period when the target component is being introduced into the ion source. When the optimal value of collision energy is not found within a single sample injection by FIA, another analysis needs to be conducted by injecting the same sample again, which brings about problems of increased sample consumption as well as elongated time required for tuning.

The above problems arise not only in the optimization of collision energy, but also in the optimization of other control parameters of the mass spectrometer, including a lens voltage applied to an ion lens, gas flow rates of nebulizer gas and drying gas used for an ion source in an electrospray ionization (ESI) method or atmospheric pressure chemical ionization (APCI) method, heating temperatures of the ion source and a heating capillary for transporting the generated ions from the ion source to a subsequent stage, and laser intensity in an atmospheric pressure photoionization (APPI) ion source.

BACKGROUND ART DOCUMENT

Patent Document

[Patent Document 1] JP-A 6-201650 (Paragraph [0015], FIG. 32)

[Patent Document 2] U.S. Pat. No. 7,479,629

DISCLOSURE OF THE INVENTION

Problems to be Solved by the Invention

The present invention has been made to solve the above problem and has an object to provide a mass spectrometer capable of determining optimal or nearly optimal control parameters with minimal times of sample injection when tuning equipment by introducing a sample into an ion source, for example, using the FIA method.

Means for Solving the Problems

The present invention aimed at solving the aforementioned problem is a mass spectrometer that is a triple quadrupole mass spectrometer in which a first-stage quadrupole mass filter and a second-stage quadrupole mass filter are placed on opposite sides of a collision cell for dissociating ions such that in which one or more components in a liquid sample are introduced into an ion source in such a manner that a temporal change in a density of the components has a peak shape, are ionized, and are undergone mass spectrometry, wherein tunings to optimize control parameters of various parts are performed based on results of mass spectrometry of known components in a sample, the mass spectrometer comprising:

a) a parameter setting means for changing a value of a collision energy for dissociating when the ions are dissociated in the collision cell, at predetermined intervals within a predetermined range, the value of the collision energy being one of the control parameters to be adjusted;

b) a result acquisition means for acquiring a mass spectrometry result each time the value of the collision energy is changed by the parameter setting means; and c) a parameter optimization means which is capable of working either in a coarse adjustment mode in which the value of the collision energy is changed at first intervals in a first predetermined range by the parameter setting means or in a fine adjustment mode in which the value of the collision energy is changed at second intervals smaller than the first intervals in a second predetermined range narrower than the first predetermined range, and which, during a period in which a target component in the sample is introduced into the ion source by one sample injection, first, in the coarse adjustment mode determines an approximate value of the collision energy based on the mass spectrometry result obtained by the result acquisition means, and subsequently, in the fine adjustment mode for the second predetermined range set to include the approximate value determines an optimal value of the collision energy based on the mass spectrometry result obtained by the result acquisition means, and the parameter optimization means obtains the optimal value of the collision energy for each of a plurality of product ions.

The mass spectrometer according to the present invention includes an ESI, APCI, APPI, or other atmospheric pressure ion source for ionizing the components of the liquid sample. For example, a sample liquid introduced by a flow injection method or an eluate flowing out of a column of a liquid chromatograph is introduced into the ion source. In either case, a target component in the sample flowing with a mobile phase (solvent) is introduced into the ion source, and the density of the target component changes to a bell-shaped (peak-shaped) distribution with the passage of time. That is, the density of the target component introduced into the ion source rises until a point in time when the density reaches a maximum, and takes a downward turn after passing the maximum point and becomes zero at a certain time.

In the mass spectrometer according to the present invention, after a sample injection point, the parameter optimization means first changes the value of the collision energy to be adjusted, at coarse intervals in a predetermined wide range and each time a change is made, the result acquisition means acquires a mass spectrometry result, which specifically is the signal strength of ions originating from the target component. Then, the mass spectrometry results at different values of the collision energy are compared, and if a significant difference is observed, for example, in the signal strength, the collision energy value which gives the greatest signal strength is determined as an approximate value of the collision energy.

In the coarse adjustment mode, since the interval is coarse, there is a possibility that an intermediate value in the interval may actually be an optimal value. Thus, once an approximate value of the collision energy is found, the parameter optimization means switches the mode from the coarse adjustment mode to the fine adjustment mode, narrows a value range of the collision energy to the neighborhood of the approximate value, and changes the value at small intervals within the narrowed range. Each time a change is made, the result acquisition means acquires mass spectrometry results on the signal strength and the like of ions originating from the target component. Since the value is changed at small intervals, the fine adjustment mode allows a value close to an optimal state to be found at least compared with the coarse adjustment mode. Thus, the collision energy value which gives the greatest signal strength at this time is judged to be the optimal value of the collision energy.

By performing two stages of adjustment in the coarse adjustment mode and fine adjustment mode during a period in which a target component in the sample is introduced into the ion source by one sample injection, the mass spectrometer according to the present invention can determine the optimal value of the collision energy under adjustment.

Actually however, it may take a lot of effort, i.e., a lot of time, to determine the approximate value of the collision energy because the density of target component is low from the beginning, making it impossible to sufficiently detect the ions originating from the target component, because there is no clear difference in signal strength among plural different values of the collision energy, and so forth. Since the density of the target component introduced into the ion source changes in an approximately mountain-shaped manner with the passage of time as described above, if an approximate value of the collision energy is determined after the maximum point of density change is passed, the component density is on a steady decline subsequently, making it less likely that the optimal value of the collision energy will be found even if a fine adjustment mode is executed.

Thus, according to one preferred form of the mass spectrometer according to the present invention, the parameter optimization means may be configured to determine the approximate value of the collision energy in the coarse adjustment mode before a point in time when the density of the target component introduced into the ion source becomes maximum.

Furthermore, if an approximate value of the collision energy is not determined in the coarse adjustment mode before a point in time when the density of the target component introduced into the ion source becomes maximum, the parameter optimization means may determine the approximate value based on a mass spectrometry result obtained by a first sample injection in the coarse adjustment mode executed continuously and subsequently determine an optimal value of the collision energy based on the mass spectrometry result obtained by the result acquisition means in the fine adjustment mode executed for the second predetermined range set to include the approximate value, during a period in which the target component is introduced into the ion source by a second injection of the same sample.

With this configuration, even if an optimal value of the collision energy cannot be found based on one sample injection, the optimal value of the collision energy can be found by injecting the same sample twice.

Possible methods for recognizing the "point in time when the density of the target component introduced into the ion source becomes maximum" include a method which finds the time point in advance using known information and a method which finds the time point in real time during analysis based on a detection signal obtained by a detector.

For example, in the case of a flow injection method, the time interval from when the sample is injected into a mobile phase by an injector to when a sample component starts to be introduced into the ion source and the elapsed time from when the sample component starts to be introduced into the ion source to when the density of the sample component almost reaches its maximum mainly depend on moving velocity of the mobile phase. The moving velocity can be found from pipe size (inside diameter, length, or other dimensions), a supply flow rate of the mobile phase, and the like, and it is easy to find the time from these analysis conditions. Also, when tuning is done using the target component in the eluate from the column exit, it is relatively easy to similarly find the time if retention time of the target component in the column is known.

On the other hand, for example, if a total ion chromatogram or extracted-ion chromatogram is created in real time based on mass spectrometry results either by using ionic strengths at the same value of the collision energy or by adding up ionic strengths obtained at plural different values of the collision energy and a peak top is found by applying peak detection to the chromatogram or a position of the peak top is predicted before it is reached based on a slope of a curve, it is possible to find the point in time when the density of the target component introduced into the ion source becomes maximum.

Note that when the mass spectrometer according to the present invention is a triple quadrupole mass spectrometer as described above, the collision energy produced when ions dissociate in the collision cell can be used as the control parameter, and the optimal value of the collision energy can be found for each of a plurality of product ions.

Effect of the Invention

In many cases, the mass spectrometer according to the present invention allows the optimal value of the collision energy to be determined based one sample injection and allows the optimal value of the collision energy to be determined by up to two sample injections even when the optimal value of the collision energy cannot be determined by one sample injection. This reduces the time and sample quantity required for equipment tuning and thereby enables efficient analysis operations.

In particular, when tuning up a collision energy whose optimal value varies with the mass-to-charge ratio to be detected, it is necessary to find an optimal value of the collision energy for each mass-to-charge ratio to be detected. Therefore, when ions with different mass-to-charge ratios are tuned simultaneously, it takes time to acquire the optimal value of collision energy for each mass-to-charge ratio. Even in such a case, the mass spectrometer according to the present invention allows the optimal value of the collision energy to be arrived at efficiently, i.e., through generally a small number of data acquisitions, without having to waste time for tuning.

BEST MODES FOR CARRYING OUT THE INVENTION

Figure 1:
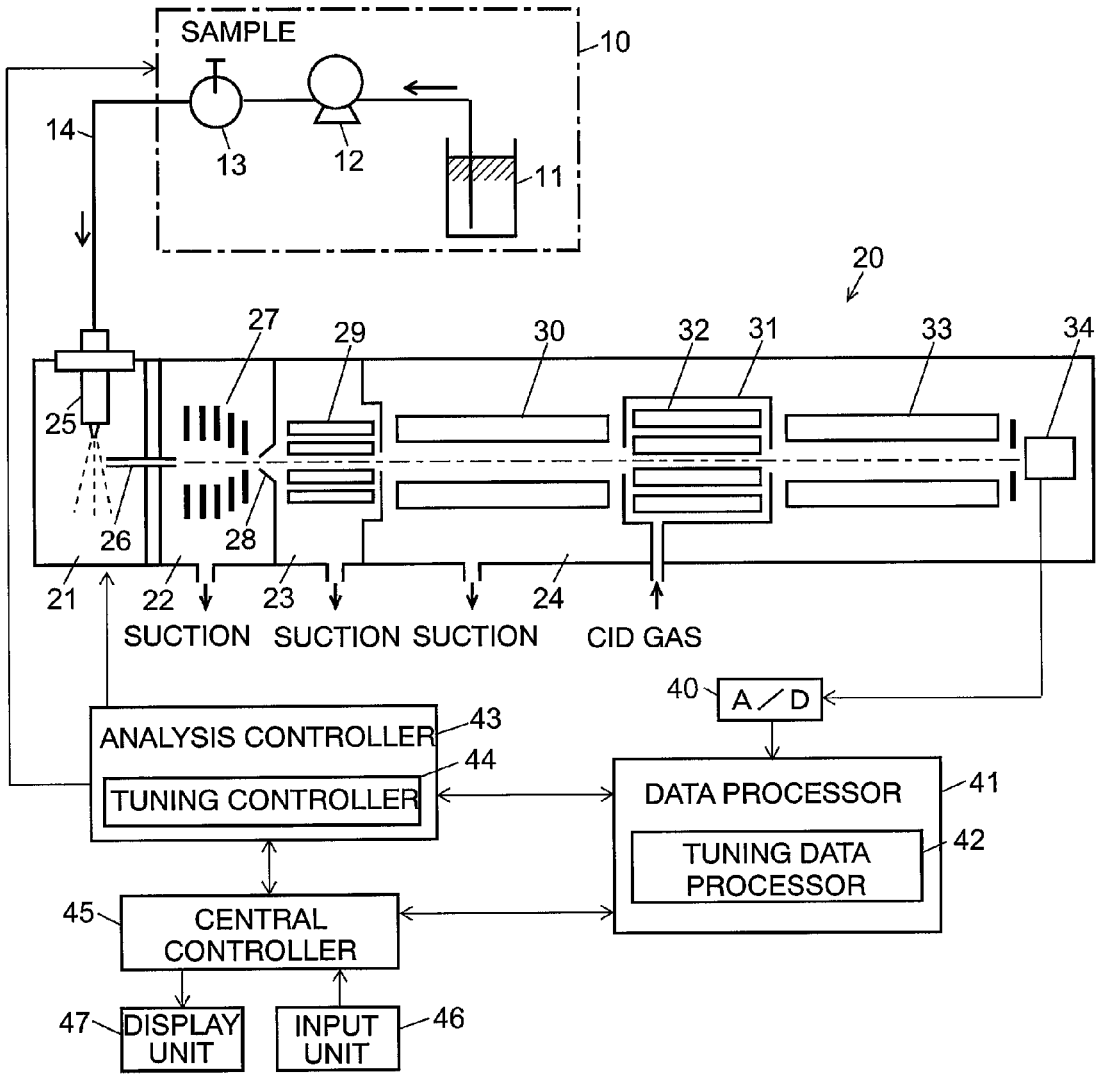
FIG. 1 is a schematic configuration diagram of a liquid chromatograph triple quadrupole mass spectrometer according to an embodiment of the present invention.

A liquid chromatograph triple quadrupole mass spectrometer according to an embodiment of the present invention will be described below with reference to the attached drawings. FIG. 1 is a schematic configuration diagram of the liquid chromatograph triple quadrupole mass spectrometer according to the present embodiment.

A liquid chromatograph 10 includes a mobile phase container 11 storing a mobile phase, a pump 12 for drawing and supplying the mobile phase at a constant flow rate, an injector 13 for injecting into the mobile phase a predetermined quantity of a sample prepared in advance, an introduction pipe 14 for introducing the sample into a mass spectrometer 20 described later. The pump 12 draws the mobile phase from the mobile phase container 11 and supplies the mobile phase through the introduction pipe 14 at the constant flow rate. When a fixed quantity of sample liquid is introduced into the mobile phase by the injector 13, the sample flows with the mobile phase and passes through the introduction pipe 14, and is introduced into the mass spectrometer 20.

The mass spectrometer 20 is configured to be a multi-stage differential exhaust system having a first intermediate vacuum chamber 22 and a second intermediate vacuum chamber 23 whose pressures gradually decrease between an ionization chamber 21 kept at substantially atmospheric pressure and a high-vacuum analysis chamber 24 exhausted by a high-performance vacuum pump (not shown). An ESI ionization probe 25 for spraying a sample solution while giving an electric charge to the sample solution is installed in the ionization chamber 21, which is communicated with the next-stage first intermediate vacuum chamber 22 through a small-diameter heating capillary 26. The first intermediate vacuum chamber 22 and the second intermediate vacuum chamber 23 are separated by a skimmer 28 having a small hole in its apex, and ion lenses 27 and 29 adapted to transport ions to the subsequent stage while converging ions are installed in the first intermediate vacuum chamber 22 and second intermediate vacuum chamber 23, respectively. In the analysis chamber 24, a first-stage quadrupole mass filter 30 adapted to separate ions according to the mass-to-charge ratio and a second-stage quadrupole mass filter 33 similarly adapted to separate ions according to the mass-to-charge ratio are installed on opposite sides of a collision cell 31 in which a multipole ion guide 32 is installed. Further, an ion detector 34 is installed in the analysis chamber 24.

In the mass spectrometer 20, when the liquid sample reaches the ESI ionization probe 25, the liquid sample which is given electric charge is sprayed from a tip of the probe 25. The charged droplets of the sprayed sample are atomized by being broken up by electrostatic forces and ions originating from a sample component are ejected in the process of the atomization. The generated ions are sent to the first intermediate vacuum chamber 22 through the heating capillary 26, converged by the ion lens 27, and sent to the second intermediate vacuum chamber 23 through the small hole in the top of the skimmer 28. The ions originating from the sample component are converged by the ion lens 29, sent to the analysis chamber 24, and introduced into a longitudinal space of the first-stage quadrupole mass filter 30. Naturally, ionization may be performed not only by ESI, but also by APCI or APPI.

During MS/MS analysis, respective predetermined voltages (obtained by superposing a radio-frequency voltage and a direct-current voltage) are applied to rod electrodes of the first-stage quadrupole mass filter 30 and the second-stage quadrupole mass filter 33, and CID gas is supplied to the collision cell 31 so as to keep the gas pressure in the collision cell 31 at a predetermined level. Among various types of ions sent into the first-stage quadrupole mass filter 30, only the ions having a particular mass-to-charge ratio corresponding to the voltage applied to each rod electrode of the first-stage quadrupole mass filter 30 are allowed to pass the filter 30, and introduced into the collision cell 31 as precursor ions. Each precursor ion is dissociated by colliding with CID gas in the collision cell 31 and thereby generates various types of product ions. The form of this dissociation depends on dissociation conditions such as collision energy and the gas pressure in the collision cell 31, and thus changes in the level of collision energy result in changes in the types of the generated product ions. When the various types of the generated product ions are introduced into the second-stage quadrupole mass filter 33, only the product ions having a particular mass-to-charge ratio corresponding to the voltage applied to each rod electrode of the second-stage quadrupole mass filter 33 pass the filter 33, reach the ion detector 34, and are detected.

A detection signal from the ion detector 34 is converted into digital data by an A/D converter 40, and inputted to a data processor 41. The data processor 41 includes a tuning data processor 42 as a functional block, which is a characteristic element of the present embodiment. Also, an analysis controller 43 for controlling respective operations of various units such as the liquid chromatograph 10 and mass spectrometer 20 includes a tuning controller 44 as a functional block, which is a characteristic element of the present embodiment. A central controller 45, to which an input unit 46 and a display unit 47 are attached, performs control at a level higher than an input/output interface and the analysis controller 43. Parts of functions of the central controller 45, the analysis controller 43, and the data processor 41 can be implemented by executing special-purpose application software on a general-purpose personal computer used as a hardware resource, where the application software has been installed on the computer in advance.

Figure 2:
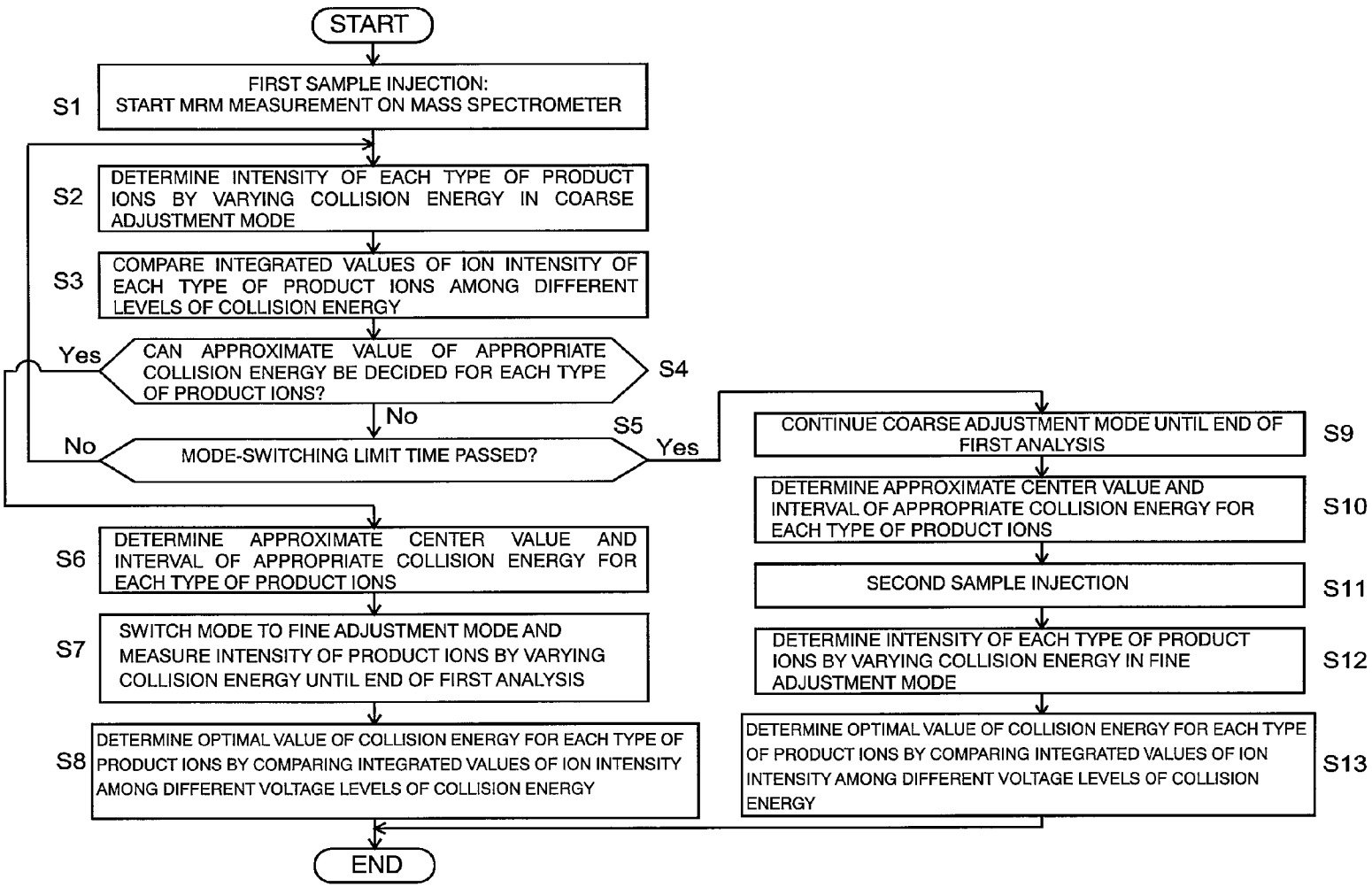
FIG. 2 is a flowchart of control and processing when tuning for collision energy optimization is performed on the liquid chromatograph triple quadrupole mass spectrometer according to the present embodiment.
Figure 3:
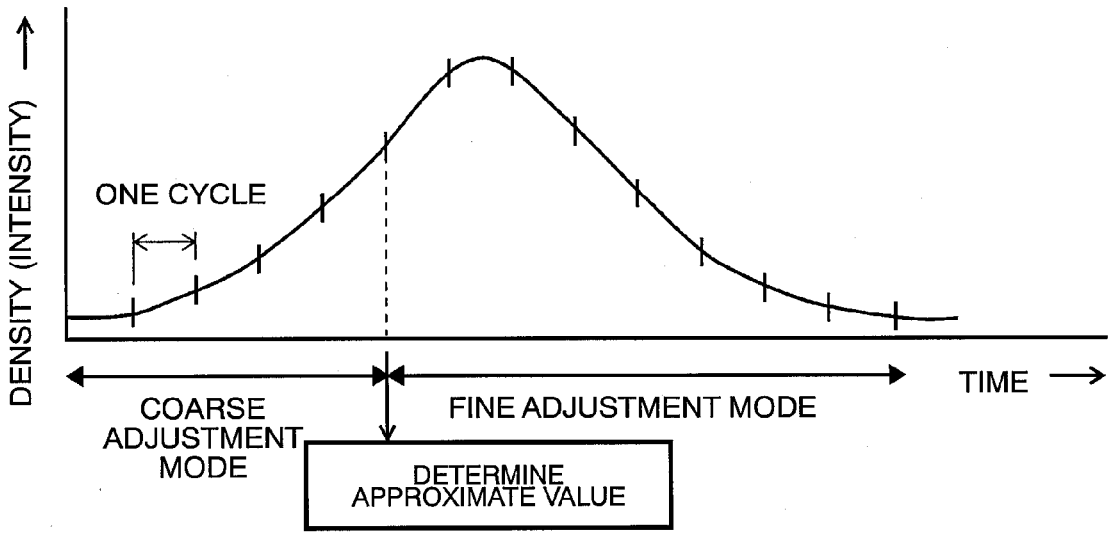
FIG. 3 is a diagram showing an example of a chromatogram used in the collision energy optimization tuning shown in FIG. 2.
Figure 4:
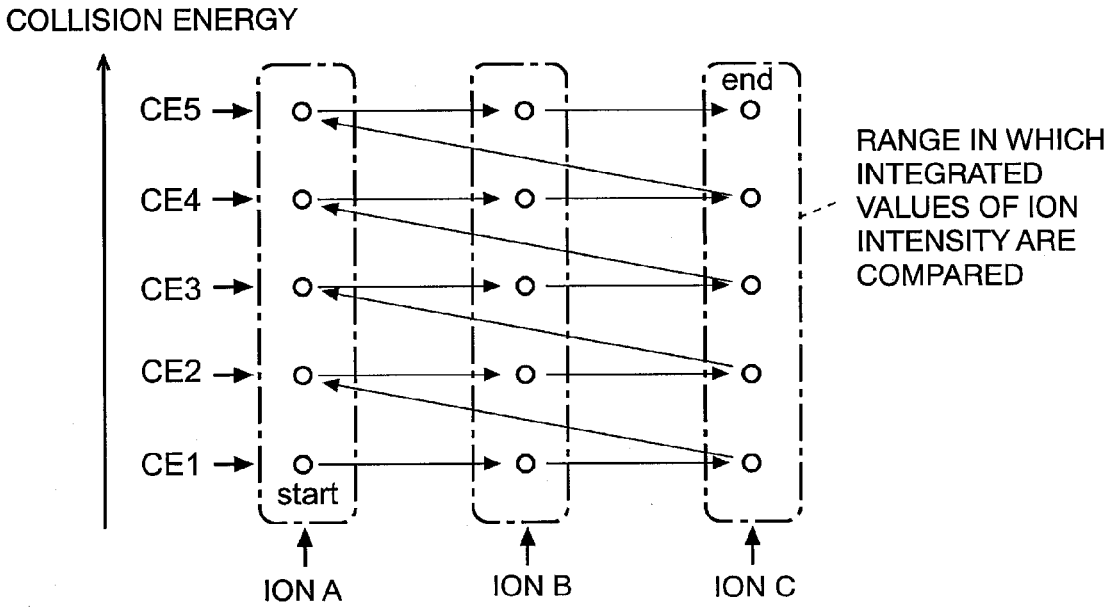
FIG. 4 is an operation explanation diagram of a coarse adjustment mode for the collision energy optimization tuning shown in FIG. 2.
Figure 5:
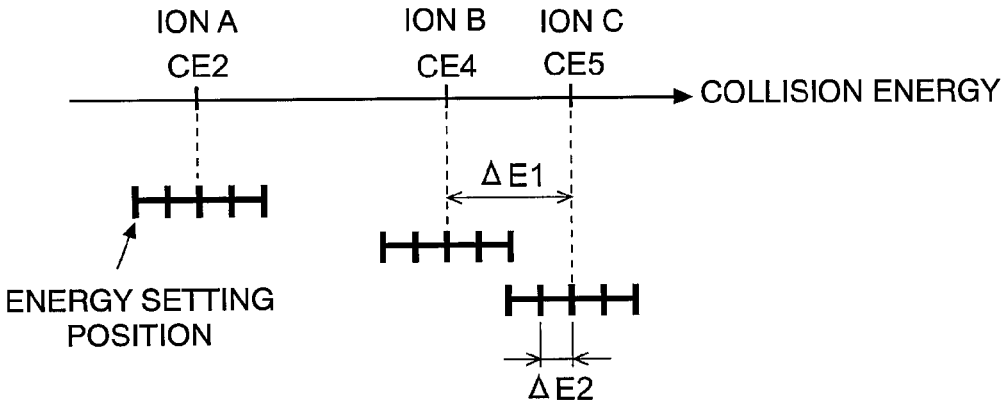
FIG. 5 is an operation explanation diagram of a fine adjustment mode for the collision energy optimization tuning shown in FIG. 2.

Next, data processing and control operations during tuning which are characteristic of the triple quadrupole mass spectrometer according to the present embodiment will be described with reference to FIGS. 2 to 5. FIG. 2 is a flow chart of a collision energy optimization process performed on the triple quadrupole mass spectrometer according to the present embodiment, and FIGS. 3 to 5 are diagrams used to illustrate the collision energy optimization process.

In this embodiment, optimal values of collision energy are determined respectively for particular product ions, i.e. three types of product ions A, B, and C having different mass-to-charge ratio generated when precursor ions having a fixed mass-to-charge ratio, which originate from a target component contained in a sample, are dissociated. Naturally, however, there may be one type of product ions or more than three types of product ions.

When a command to perform a collision energy optimization process is issued, a predetermined sample is injected into the mobile phase from the injector 13 under the control of the tuning controller 44. Also, almost simultaneously with this or at an appropriate time point appropriately earlier or later than this, the mass spectrometer 20 starts MS/MS analysis based on MRM measurement in coarse adjustment mode (step S1). In this embodiment, it is assumed that appropriate level of collision energy for each type of product ions A, B, and C is totally unknown, and a set value of collision energy is varied at coarse intervals over a wide energy range during the MRM measurement performed first, following the first sample injection. Specifically, as shown in FIG. 4, the interval is set to ΔE1 and the energy range is divided into CE1 to CE5, and the collision energy is varied in five steps CE1, CE2, CE3, CE4, and CE5.

In the mass spectrometer 20, the voltages applied to the rod electrodes of the first-stage quadrupole mass filter 30 are set such that the ions originating from the target component and having a particular mass-to-charge ratio will pass the fist-stage quadrupole mass filter 30. On the other hand, the voltages applied to the rod electrodes of the second-stage quadrupole mass filter 33 are set such that the mass-to-charge ratio of the ions passing through the second-stage quadrupole mass filter 33 will be switched in the order—the product ions A, product ions B, and product ions C—at each of the five levels CE1, CE2, CE3, CE4, and CE5 of collision energy. That is, as shown in FIG. 4, first, regarding various types of product ions generated at the lowest collision energy CE1, the second-stage quadrupole mass filter 33 is switched such that the product ions A, product ions B, and product ions C will pass in this order, and signal strength data on each type of product ions is acquired.

Then, the collision energy is switched to CE2, and signal strength data on three types of product ions is similarly acquired at collision energy CE2. In this way, by changing the product ions to be detected while changing the collision energy, signal strength data is acquired sequentially for all combinations of the five levels CE1, CE2, CE3, CE4, and CE5 of collision energy and three types of product ions A, B, and C. This is one cycle of measurements, and this cycle is repeated from the moment when the optimization process is started with the sample being injected into the mobile phase by the injector 13 (step S2).

Since signal strength data on each combination of collision energy and product ions is obtained in each cycle of measurements, the tuning data processor 42 in the data processor 41 integrates signal strength data on each level of collision energy and each type of product ions in each cycle of measurements, compares the integrated data values of each type of product ions among different levels of collision energy as shown in FIG. 4, and finds the collision energy which maximizes the ion intensity (step S3). FIG. 3 is a diagram showing an example of changes in the density of a target component introduced into the ionization probe 25, with the passage of time from the moment of sample injection. For example, if a total ion chromatogram of a target component or an extracted-ion chromatogram of a target component at a particular mass-to-charge ratio is created, its curve should have a shape such as shown in FIG. 3. As shown in FIG. 3, the density of the target component is low at first, but rises gradually. Thus, the integrated value of the ion intensity increases with increasing in the number of the cycles, and differences in ion intensity due to differences in the levels of collision energy become clear.

The tuning data processor 42 compares the integrated data values among different levels of collision energy at the end of each cycle as described above. For example, when a difference between the greatest integrated data value and the second greatest integrated data value is larger than a predetermined value (i.e., when there is a significant difference), the tuning data processor 42 determines the collision energy corresponding to the greatest integrated data value to be an interim optimal value and determines the interim optimal value as being an approximate value of the collision energy. If there is no integrated data value which satisfies the above condition, it is regarded that the approximate value of the collision energy is undecided at that point. Then, it is determined whether approximate values of collision energy have been decided for all types of product ions (step S4). If no approximate value has been decided for any type of product ions, it is determined whether a mode-switching limit time has been passed (step S5).

The mode-switching limit time is set, for example, to the time point shown in FIG. 3 at which the density of the target component reaches its maximum. Therefore, for example, the tuning data processor 42 monitors a temporal change in the sum total of the ion intensities of the three types of product ions A, B, and C at one level of collision energy in one cycle, and when the temporal change takes a downward turn, the tuning data processor 42 determines that the maximum point of density has been passed. Alternatively, by detecting a sharp decline in the rate of change of increase, it can be recognized, at an earlier time, i.e., before passage through the maximum point of density, that the density is nearing its maximum point. Alternatively, by adding up all ion intensity signal data obtained in one cycle, the mode-switching limit time may be determined based on the temporal change of the resulting sum. In any case, the mode-switching limit time needs to be set to a time point before the density of the target component passes through the maximum point and decreases greatly. If the determination in step S5 is "No," i.e., the mode-switching limit time has not been reached yet, the flow returns to step S2.

If a "Yes" determination is made in step S4 before the mode-switching limit time is reached as shown in FIG. 3, since approximate values of collision energy have been decided for all the types of product ions, the flow goes from step S4 to step S6, and the tuning data processor 42 determines a variation range and interval ΔE2 of collision energy used for each type of product ions in the fine adjustment mode which follows the coarse adjustment mode.

For example, the variation range of collision energy can be determined by taking the approximate value as a center value, multiplying the interval ΔE1 in the coarse adjustment mode by a predetermined coefficient smaller than 1, and setting the resulting product as an upper and lower margin of fluctuation from the center value. In this case, the greatest variation range of collision energy in the fine adjustment mode is 2×ΔE1. Also, within this range, the interval ΔE2 is set to an appropriate value smaller than ΔE1 to obtain a value as close to the optimal value of collision energy as possible. For example, the interval ΔE2 may be obtained by multiplying ΔE1 by a predetermined coefficient smaller than 1, or the interval ΔE2 may be derived by determining the number of intervals in advance and dividing the collision energy variation range defined as described above by the number of intervals. The method for obtaining the variation range and interval ΔE2 of collision energy can be decided as appropriate, but in any case, it is assumed that in the fine adjustment mode, the collision energy is varied at smaller intervals in a smaller range than those in the coarse adjustment mode.

FIG. 5 shows an example of how to set the variation range and interval ΔE2 of collision energy in fine adjustment mode when the collision energy CE2, the collision energy CE4, and the collision energy CE5 are obtained as approximate values for the product ions A, product ions B, and product ions C, respectively, as a result of processing in the coarse adjustment mode described above. In this way, once the value of collision energy to be varied in the fine adjustment mode is decided for each type of product ions, the tuning controller 44 switches from coarse adjustment mode to fine adjustment mode, acquires signal strength data on every combination of the product ion types and different collision energy levels as in the case of the coarse adjustment mode described above, and integrates signal strength data on the each level of collision energy and each type of product ions in each cycle (step S7). Then, when the introduction of the target component is finished, the tuning controller 44 compares the integrated data values of each type of product ions among different levels of collision energy, and determines the collision energy with the greatest integrated data value as an optimal value (step S8). Consequently, the optimal values (in the strict sense, the closest of the examined values to the optimal values) of collision energy are obtained for the product ions A, B, and C.

On the other hand, if the mode-switching limit time is reached before a "Yes" determination is made in step S4, i.e., if the determination in step S5 is "Yes," since the density of the target component falls subsequently, even if the mode is switched from coarse adjustment mode to fine adjustment mode, it is less likely that appropriate collision energy can be found in the fine adjustment mode. Thus, if the determination in step S5 is "Yes," the tuning controller 44 stops carrying out the analysis further in the fine adjustment mode at the time of the first sample injection and switches control so as to continue the coarse adjustment mode until the introduction of the target component is finished (step S9). Then, when the introduction of the target component is finished, the tuning controller 44 compares the integrated data values of each type of product ions among different levels of collision energy, finds out the collision energy with the greatest integrated data value and determines it as an optimal value, and determines the variation range and interval ΔE2 of collision energy, as in the case of step S6, in the fine adjustment mode based on the approximate value (step S10).

Subsequently, under the control of the tuning controller 44, the same sample is injected into the mobile phase by the injector 13 (step S11), the processes of steps S12 and S13 similar to steps S7 and S8 are carried out for this second sample injection to obtain the optimal values of collision energy for the product ions A, B, and C.

Thus, in the collision energy optimization process described above, if the optimal value for each type of product ions is obtained at the time of the first sample injection, for example, until the signal strength of the ions originating from the target component becomes maximum, the optimal values of collision energy can be obtained for all the product ions by the analysis based on one sample injection. Even if the optimal value for each type of product ions is not found at the time of the first sample injection until the signal strength of the ions originating from the target component becomes maximum, the optimal values of collision energy can be obtained for all the product ions by the analysis based on two sample injections.

Note that although in the above embodiment, timing for a possible transition from coarse adjustment mode to fine adjustment mode is determined based on actual measured ion intensity data assumed to almost follow the temporal change in the density of the target component, this may be determined in terms of time in advance. That is, the temporal change in the density of the target component depends on the flow velocity of the mobile phase delivered by the pump 12 as well as on length and other dimensions of the introduction pipe 14, and the like. Therefore, once these analysis conditions are known, the time required from the point of sample injection to the point when the target component density becomes almost maximum can be obtained approximately by calculation. Thus, if the required time is found beforehand by calculation and if it is determined in the process of step S5 that the mode-switching limit time is reached when the required time elapses, the optimal value of collision energy can be obtained by up to two sample injections such as described above.

Although with the liquid chromatograph mass spectrometer according to the embodiment described above, the sample introduced into the mobile phase is introduced directly into the mass spectrometer 20 together with the mobile phase without separating sample components using the liquid chromatograph 10, the components in the sample may be separated by the column of the liquid chromatograph 10 and the resulting eluate may be introduced into the mass spectrometer 20. In that case, even if the sample contains plural components, an optimization process such as described above can be applied to a peak originating from a particular component in the sample. Also, it is evident that as long as the liquid sample is introduced into the ion source such that the temporal change in the density of one or more sample components will have a peak, the technique for introducing the sample into the ion source is not limited to the one described above.

The embodiment described above is merely an example of the present invention, and it is obvious that any change, addition, or modification made as appropriate with respect to features other than those described above within the spirit of the present invention falls within the scope of the present patent application.

EXPLANATION OF NUMERALS

10 . . . Liquid chromatograph
11 . . . Mobile phase container
12 . . . Pump
13 . . . Injector
14 . . . Introduction pipe
20 . . . Mass spectrometer
21 . . . Ionization chamber
22 . . . First intermediate vacuum chamber
23 . . . Second intermediate vacuum chamber
24 . . . Analysis chamber
25 . . . ESI ionization probe
26 . . . Heating capillary
27 . . . Ion lens
28 . . . Skimmer
29 . . . Ion lens
30 . . . First-stage quadrupole mass filter
31 . . . Collision cell
32 . . . Multipole ion guide
33 . . . Second-stage quadrupole mass filter
34 . . . Ion detector
40 . . . A/D converter
41 . . . Data processor
42 . . . Tuning data processor
43 . . . Analysis controller
44 . . . Tuning controller
45 . . . Central controller
46 . . . Input unit
47 . . . Display unit

The invention claimed is:

1. A mass spectrometer that is a triple quadrupole mass spectrometer in which a first-stage quadrupole mass filter and a second-stage quadrupole mass filter are placed on opposite sides of a collision cell for dissociating ions such that one or more components in a liquid sample are introduced into an ion source in such a manner that a temporal change in a density of the components has a peak shape, are ionized, and are undergone mass spectrometry, wherein tunings to optimize control parameters of various parts are performed based on results of mass spectrometry of known components in a sample, the mass spectrometer comprising:

a) a parameter setting means for changing a value of a collision energy for dissociating when the ions are dissociated in the collision cell, at predetermined intervals within a predetermined range, the value of the collision energy being one of the control parameters to be adjusted;

b) a result acquisition means for acquiring a mass spectrometry result each time the value of the collision energy is changed by the parameter setting means; and c) a parameter optimization means which is capable of working either in a coarse adjustment mode in which the value of the collision energy is changed at first intervals in a first predetermined range by the parameter setting means or in a fine adjustment mode in which the value of the collision energy is changed at second intervals smaller than the first intervals in a second predetermined range narrower than the first predetermined range, and which, during a period in which a target component in the sample is introduced into the ion source by one sample injection, first, in the coarse adjustment mode determines an approximate value of the collision energy based on the mass spectrometry result obtained by the result acquisition means, after which the parameter optimization means switches to the fine adjustment mode, sets the collision energy range to the neighborhood of the approximate value, and subsequently, in the fine adjustment mode for the second predetermined range set to include the approximate value determined by the coarse adjustment mode determines an optimal value of the collision energy based on the mass spectrometry result obtained by the result acquisition means, and the parameter optimization means obtains the optimal value of the collision energy for each of a plurality of product ions.

2. The mass spectrometer according to claim 1, wherein the parameter optimization means determines the approximate value of the collision energy in the coarse adjustment mode before a point in time when the density of the target component introduced into the ion source becomes maximum.

3. The mass spectrometer according to claim 2, wherein if an approximate value of the collision energy is not determined in the coarse adjustment mode before a point in time when the density of the target component introduced into the ion source becomes maximum, the parameter optimization means determines the approximate value based on a mass spectrometry result obtained by a first sample injection in the coarse adjustment mode executed continuously and subsequently determines an optimal value of the collision energy based on the mass spectrometry result obtained by the result acquisition means in the fine adjustment mode executed for the second predetermined range set to include the approximate value, during a period in which the target component is introduced into the ion source by a second injection of the same sample.

4. The mass spectrometer according to claim 2, wherein the parameter optimization means estimates the point in time when the density of the target component introduced into the ion source becomes maximum in advance by calculation using known information.

5. The mass spectrometer according to claim 2, wherein the parameter optimization means finds the point in time when the density of the target component introduced into the ion source becomes maximum in real time during analysis based on a detection signal obtained by a detector.

* * * * *